US006481256B1

(12) United States Patent
Beyer et al.

(10) Patent No.: US 6,481,256 B1
(45) Date of Patent: Nov. 19, 2002

(54) PRESS FOR EXTERNAL HIGH-PRESSURE FORMING

(75) Inventors: Joachim Beyer, Ravensburg; Ulrich Hermann, Ostfildern, both of (DE)

(73) Assignee: Muller Weingarten AG, Weingarten (DE)

( * ) Notice: Subject to any disclaimer, the term of this patent is extended or adjusted under 35 U.S.C. 154(b) by 0 days.

(21) Appl. No.: 09/592,908

(22) Filed: Jun. 13, 2000

(30) Foreign Application Priority Data

Jun. 23, 1999 (DE) ..... 199 28 422

(51) Int. Cl.[7] ..... B21D 22/10; B21D 39/08
(52) U.S. Cl. ..... 72/57; 72/60; 72/350
(58) Field of Search ..... 72/350, 351, 57, 72/58, 60, 63

(56) References Cited

U.S. PATENT DOCUMENTS 2,783,728 A * 3/1957 Hoffmann ..... 72/57
3,668,914 A * 6/1972 Voitsekhovsky et al. ..... 72/57
4,314,468 A * 2/1982 Bari et al. ..... 72/57
4,689,979 A * 9/1987 Otsuka et al. ..... 72/57
5,644,943 A * 7/1997 Lanz ..... 72/348

FOREIGN PATENT DOCUMENTS

| | | |
|---|---|---|
| DE | 1240 801 | 5/1967 |
| DE | 198 19 950 | 11/1998 |
| DE | 19724767 | 12/1998 |

* cited by examiner

*Primary Examiner*—David Jones
(74) *Attorney, Agent, or Firm*—Morgan, Lewis & Bockius LLP

(57) ABSTRACT

A forming press for external high-pressure forming is proposed, in which the fluid box (10) is arranged stationarily. Working cylinders (6) are integrated in the ram (2) so as to achieve a compact design, and the sheetholding and closing force is applied by short-stroke cylinders (7).

8 Claims, 3 Drawing Sheets

PRESS FOR EXTERNAL HIGH-PRESSURE FORMING

FIELD OF THE INVENTION

The invention relates to a press, in particular a forming press which works by the method of external high-pressure forming, carries out the forming process with a small number of operating steps by virtue of the proposed arrangement of the driving and forming subassemblies and is distinguished by a compact rigid design. A sheet holder system having high flexibility, along with a low overall height, is also proposed.

DESCRIPTION OF THE RELATED ART

External high-pressure forming (EHF), also designated as a hydromechanical drawing method or hydrostatic cold-forming method, has been known for many years. The method is already described in detail in DE 12 40 801 of 1961 and reference is made to this description. The increased use of external high-pressure forming as an inexpensive alternative in small-lot production leads to a growing demand for appropriately equipped forming presses. Developments in hydraulic and electronic control engineering also have a beneficial effect on improvements in method. A multi-purpose press working by external high-pressure forming is disclosed in DE 198 19 950. This machine, designed as a hydraulic press, is also designed additionally for forming by internal high pressure and as a deep-drawing press. For the external high-pressure forming application, following method steps then take place:

1 Insert sheet billet
2 Move the holding-down device downward
3 Move the fluid box upward by means of the working cylinders
4 Apply the holding-down force
5 Move the ram downward
6 Move the working cylinders upward shortly before the ram reaches bottom dead center (BDC)
7 Regulation of the fluid pressure in the fluid box
8 The ram moves to BDC, and engage interlocks
9 The working cylinders move further upward and the holding-down cylinders are displaced
10 By the fluid box being moved further up, the clamped sheet billet is drawn via the die located on the fixed ram
11 The holding-down device is pressed to blocking with the spacers and the top spar
12 The working cylinders increase the closing pressure
13 A fluidic high pressure is built up in the fluid box, and the workpiece contour is produced by means of a platicizing operation
14 Relief of pressure
15 The working cylinders lower the fluid box
16 The interlock is disengaged
17 The ram together with the holding-down device is moved up
18 The workpiece is extracted Quite apart from the multiplicity of process steps, the press is, of course, not designed optimally for the respective intended use, on the basis of the object of operating it as a universal or multi-purpose press.

SUMMARY OF THE INVENTION

The object on which the invention is based is to propose a press of high rigidity for external high-pressure forming, which makes it possible to reduce the process steps and in which the fluid box can be arranged stationarily and which has available a freely selectable and demand-related arrangement of the sheetholder cylinders.

The invention is based on the idea of selecting the arrangement of the fluid cylinders in such a way that a rigid and compact design is ensured as a result of a direct position in the force flux. Since the ram and sheetholder are moved jointly, only one movement cylinder is necessary and the sheetholder cylinders may be designed as straightforward short-stroke cylinders. These short-stroke cylinders are not arranged in a rigid system, but, instead, the number and arrangement of these can be selected optimally for the respective workpieces according to the requirements of the forming process. Corresponding coupleable connections to the power line or lines are provided.

The working cylinders carrying the die are integrated directly in the ram. The counterpressure is regulated in a stationary fluid box, thus making it possible to have fixed pipework, this being a further advantage during high-pressure operation.

The process sequence is as follows:

1 Insert a sheet billet
2 Joint downward movement of the ram and sheetholder
3 Interlocking of the ram with sheetholder by means of engaging spacer pieces
4 Downward movement of the die into the fluid box by means of working cylinders, at the same time
4.1 Pressure regulation in the fluid box
4.2 Regulation of the sheet holding force via short-stroke cylinders
5 Interlocking of the die at bottom dead center
6 Build-up of the maximum sheet holding force via short-stroke cylinders
7 High-pressure build-up in the fluid box and operation of plasticizing the workpiece (calibration)
8 Relief of pressure
9 The interlock is disengaged
10 The ram together with the holding-down device is moved up
11 The workpiece is extracted The entire process sequence consequently consists of altogether 11 operating steps which also even partially overlap. This also ensures, as a further advantage, a high cycle rate and an economical use of the press.

A favorable energy balance due to small oil quantities being required is achieved as a result of the common movement cylinder for the ram and sheetholder and the use of the short-stroke cylinders for regulating the sheet holding force and for building up the maximum locking force. Since the short-stroke cylinders do not themselves carry out the forming travel, but execute merely a stroke of a few millimeters, an inexpensive design with a low overall height is obtained. This is also advantageous when multi-point support is necessary on account of the workpiece geometry.

It is to be understood that both the foregoing general description and the following detailed description are examples and explanatory and are intended to provide further explanation of the invention as claimed.

BRIEF DESCRIPTION OF THE DRAWINGS

The accompanying drawings, which are included provide a further understanding of the invention and are incorporated in and constitute a part of this specification, illustrate embodiments of the invention and together with the description above to explain the principles of the invention.

DESCRIPTION OF THE PREFERRED EMBODIMENTS

Figure 1:
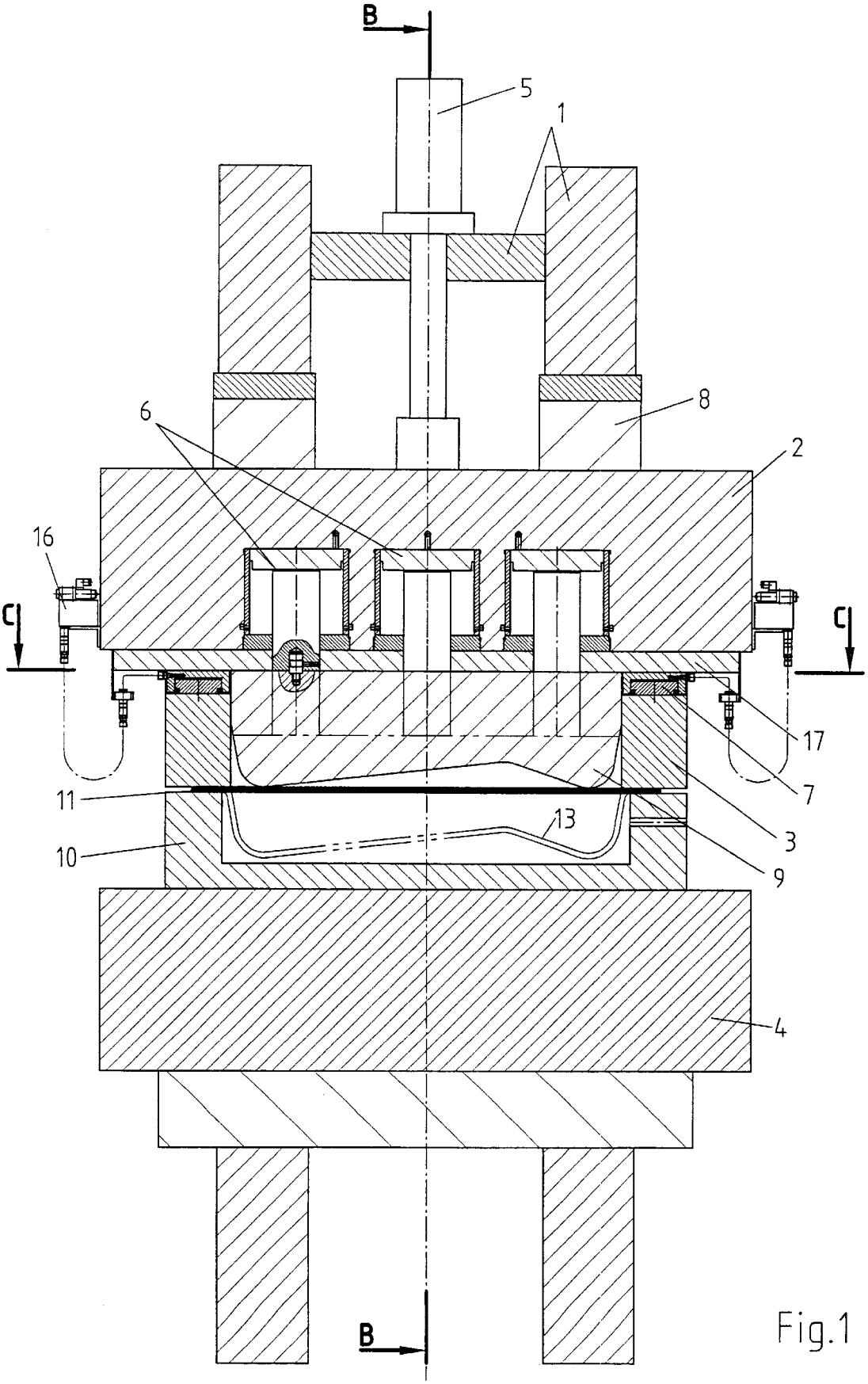
FIG. 1 shows a front view of the forming press in sectional illustration along the sectional line A—A in FIG. 3.

FIG. 1 shows the basic design of the forming press, consisting of the press column 1, ram 2, sheetholder 3, platen 4, working cylinder 5, working cylinders 6, short-stroke cylinders 7, interlock 8, die 9, fluid box 10 and sheet billet 11.

The start of the following operation can be seen in the illustration. The movement cylinder 5 has lowered the ram 2 together with the sheetholder 3 until the sheetholder 3 sits on the sheet billet 11. A regulated pressure build-up for the sheetholding force is carried out, depending on the forming operation, via short-stoke cylinders 7. The number and arrangement of the short-stroke cylinders 7 are selected in dependence on the die and on the sheet billet. Determining parameters for the die are, for example, the die size and the die contour, and, as regards the sheet billet, inter alia, mechanical material properties, forming speeds and tribological actions are important. In order to achieve the desired forming results, each short-stroke cylinder 7 may be regulated individually or be closed together in groups.

In the further process sequence, the working cylinders 6, integrated in the ram 2, move, together with the die 9, toward the fluid cushion located in the fluid box 10. A pressure regulating device, not illustrated in any more detail, sets the necessary pressure of the fluid cushion.

Figure 3:
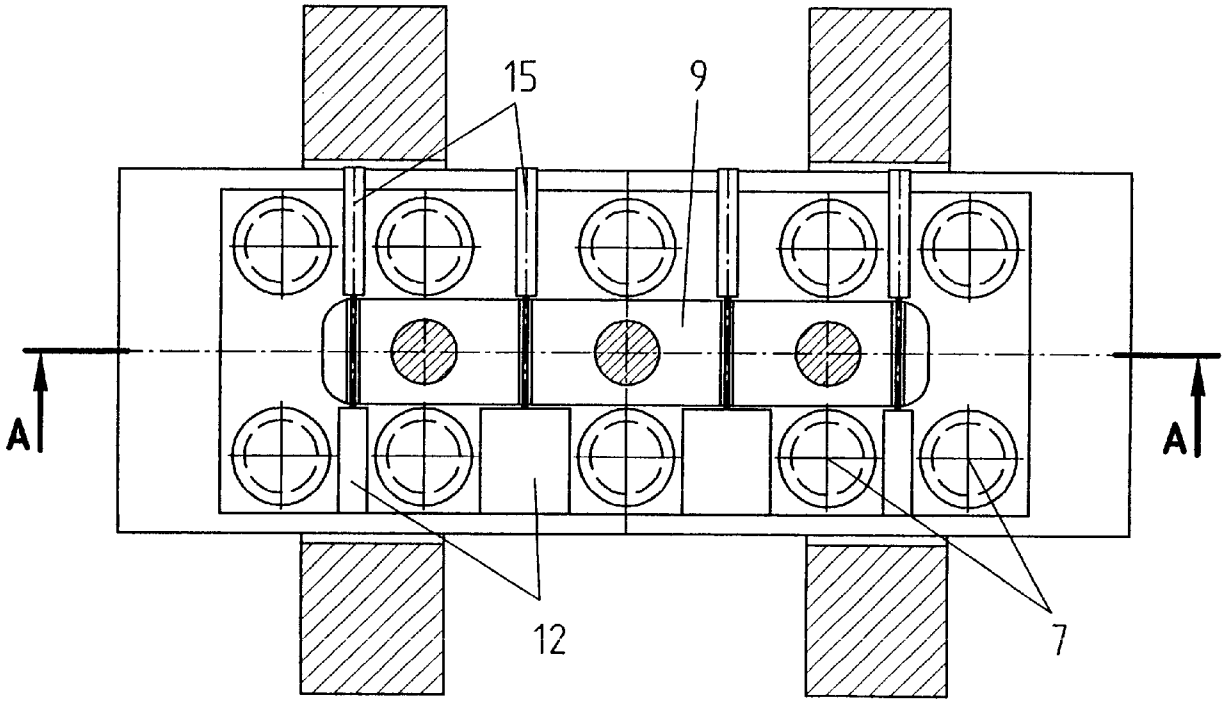
FIG. 3 shows a top view of the forming press along sectional line C—C.

The die is moved into its lowest position 13 which is limited, for example, by stops, and is interlocked by means of engageable die spacers 12 illustrated in FIG. 3. This interlock is necessary in order to support reliably the high pressure which is built up in the fluid box 10 for the conclusion of the forming operation. By means of this pressure, the workpiece is pressed into the die contour in a kind of calibration and is shaped. For this purpose, short-stroke cylinders 7 generate a maximum sheetholding force which ensures that the edge of the sheet billet or of the workpiece is clamped reliably. The expansions or compressions of the press components which occur due to these forces are advantageously compensated by means of the arrangement and the stroke of the short-stroke cylinders 7. Fluid couplings 16 serve for connecting the short-stroke cylinders necessary in each case to the power supply. A holding or die top plate 17 is connected to the ram 2 and makes it possible to mount and demount the working cylinders 6 in a simple way.

Figure 2:
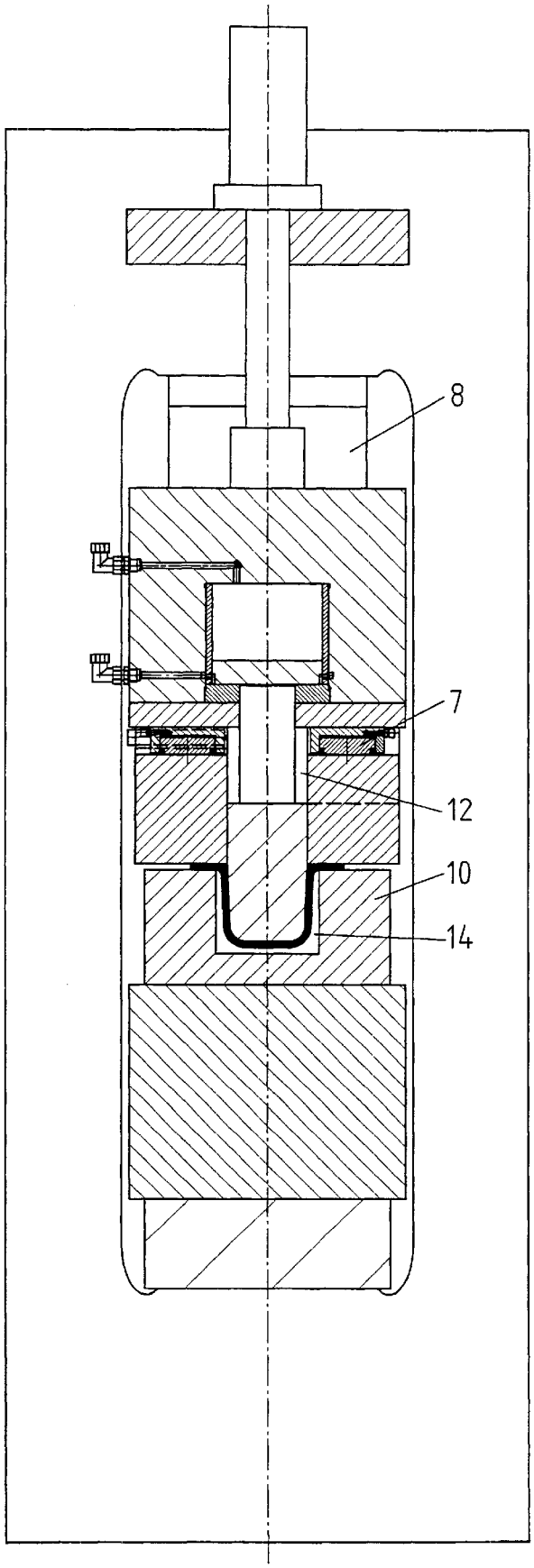
FIG. 2 shows a side view of the forming press in a sectional illustration B—B, but with the die at bottom dead center.

FIG. 2 shows the situation at bottom dead center. The pressure medium 14 is subjected in the fluid box 10 to a maximum pressure at which the ultimate component geommetry is shaped in a plasticizing forming operation. An after flow of the clamped edge of the sheet billet is undesirable in this calibrating operation and is reliably prevented by the maximum locking force generated by the short-stroke cylinders 7. The high forces occurring in this phase are absorbed in a kind of closed system as a result of interaction with the engaged ram interlocks 8 and die spacers 12. Another advantage of the selected arrangement becomes clear here, since, in this concept, the compressibility of the fluid medium is essentially ruled out.

FIG. 3 is a sectional illustration which shows an arrangement of the short-stroke cylinder 7. As already mentioned, both the arrangement and the number of short-stroke cylinders 7 are freely selectable according to the component. The moveable die spacers are designated by 12 and the associated displacement cylinders by 15. In the position shown, the die spacers 12 are disengaged, that is to say the die 9 is no longer interlocked.

The invention is not restricted to the exemplary embodiment described and illustrated. It also embraces, within the scope of the current claim 1, all refinements which are available to a person skilled in the art.

What is claimed is:

1. A press for external high-pressure forming comprising:

a reciprocating interlockable ram and sheetholder;

a pressure regulated fluid box receiving pressure medium;

sheetholder cylinders for controllably pressing the sheetholder against the fluid box to thereby hold an edge of a workpiece between the sheetholder and the fluid box, wherein the sheetholder cylinders are short-stroke cylinders; and working cylinders integrated in the ram for driving a die against the workpiece pressed between the sheetholder and the fluid box, whereby the die driven by the working cylinders and a pressure of the fluid box shape the workpiece in the contour of the die.

2. The press for high-pressure forming as claim in claim 1, further comprising a common movement cylinder for driving the ram and the sheetholder.

3. The press for high-pressure forming as claimed in claim 1, wherein an arrangement and number of the short-stroke cylinders is selected based on properties of the workpiece.

4. The press for external high-pressure forming as claimed in claim 1, further comprising fluid couplings provided on the ram for supplying fluid to the sheetholder cylinders.

5. The press for external high-pressure forming as claimed in claim 1, wherein the short-stroke cylinders are pressure-regulated individually or in groups.

6. The press for external high-pressure forming as claimed in claim 1, wherein the short-stroke cylinders are pressure-regulated according to predetermined desired pressure curves for sheet holding force of the workpiece against the fluid box.

7. The press for external high-pressure forming as claimed in claim 1, wherein the workpiece is a sheet billet and wherein the short-stroke cylinders are pressure-loaded in such a way as to clamp the sheet billet against the fluid box.

8. The press for external high-pressure forming as claimed in claim 1, wherein the die is interlockable with an interlocking device in order to fix the die when the die is driven against the workpiece and the fluid box is under high pressure.

* * * * *